US006010012A

United States Patent [19]

Gero

[11] Patent Number: 6,010,012

[45] Date of Patent: Jan. 4, 2000

[54] FLUIDIZING DETRASHING IMPELLER

[75] Inventor: William A. Gero, Pittsfield, Mass.

[73] Assignee: Beloit Technologies, Inc., Wilmington, Del.

[21] Appl. No.: 08/963,217

[22] Filed: Nov. 3, 1997

[51] Int. Cl.[7] ..... B07B 1/04; B01D 1/20; D21B 21/24; D21B 1/08

[52] U.S. Cl. ..... 209/306; 209/305; 209/273; 210/456; 162/4

[58] Field of Search ..... 209/273, 274, 209/278, 283, 300, 305, 306; 210/456, 499; 162/4

[56] References Cited

U.S. PATENT DOCUMENTS

| | | |
|---|---|---|
| 3,009,656 | 11/1961 | Martindale . |
| 3,953,325 | 4/1976 | Nelson . |
| 4,604,193 | 8/1986 | Lamort . |
| 4,919,797 | 4/1990 | Chupka et al. . |
| 5,476,178 | 12/1995 | Lamor . |
| 5,645,724 | 7/1997 | Lamor . |
| 5,798,025 | 8/1998 | Iwashige ..... 209/273 X |

FOREIGN PATENT DOCUMENTS 1551753 12/1968 France .

*Primary Examiner*—Donald P. Walsh
*Assistant Examiner*—Brett C. Martin

[57] ABSTRACT

A de-trashing unit has a rotor fabricated from steel blank. The rotor has two swept blades with blunt leading edges and relieved trailing edges. The rotor is driven to rotate over a trash screen with holes of between one-quarter and one-half inch in diameter. The blade is positioned with a clearance between the blade and the screen of between 0.005 and 0.010 inches. The relieved portions of the blades face the screen while the trailing edges of the blade are tapered between 18 and 30 degrees away from the screen surface. The blade taper creates a strong negative pressure pulse which keeps the screen clear. Holes drilled through the relieved portion of the blade allow circulation through the blade into the region of low pressure generated by the relieved portions passing over the screen. The circulation created by the holes creates microturbulence which keeps a water and paper fiber slurry fluidized.

11 Claims, 2 Drawing Sheets

FLUIDIZING DETRASHING IMPELLER

FIELD OF THE INVENTION

The present invention relates to pulp screens in general and to pulp screens used for de-trashing pulp from recycled paper in particular.

BACKGROUND OF THE INVENTION

In a typical modern office waste paper is separated from other wastes and collected for recycling. Nevertheless, paper suitable for recycling is rarely completely separated from other wastes which cannot be recycled as paper. Paper for recycling is often contaminated with plastic bags, transparent overhead view-foils, X-Ray film, envelope windows, and paper with high wet strain such as Express Mail envelopes and bible papers. Heavy contaminants such as metal and rock may also be present.

Because the cost of sorting recycled paper by hand is generally prohibitive, all the trash which is collected as recyclable paper is commonly placed in a pulping device where it is mixed with water and chemicals and made into a pumpable slurry. The slurry thus produced is about 12 to 18 percent pulp by weight. The slurry is diluted with water to about 4 percent fiber dry weight as it is allowed to flow to a de-trashing unit. A typical de-trashing unit consists of a cylindrical tank with one end forming a screen through which the slurry is drawn by a pump. To aid the passage of the slurry through the screen a three bladed impeller is mounted adjacent to the screen and caused to rotate.

Unfortunately, with existing de-trashing units the impeller blades shred the non-pulping contaminants such as plastic bags, view-foils, envelope windows, etc. The shredded material then passes through the screen in the de-trasher and must be removed by additional processing steps. Inevitably the pumps between the additional pieces of processing equipment shred the contaminants into ever smaller particles so that a certain portion of the contaminants end up in the finished paper. Removal is possible but involves considerable additional cost. Contaminants which are not removed result in a final product which is of lower quality and value.

In addition to shredding the contaminants, the rotor in existing de-trashing units becomes laden with a buildup of contaminants such as plastic bags which wrap around the impeller. This buildup of contaminants increases the power required for operating the de-trashing unit and requires cleaning of the unit every eight hours.

What is needed is an improved de-trashing unit which can separate trash without significantly shredding lightweight plastic and without becoming clogged with trash.

SUMMARY OF THE INVENTION

The de-trashing unit of this invention employs a rotor which is fabricated from an integral stainless steel blank. The rotor has two swept blades which have blunt leading edges and a trailing edge which is relieved. The blade is driven to rotate over a trash screen with holes of between one-quarter and one-half inch in diameter. The blade is positioned to have a clearance between the blade and the screen of between 0.005 and 0.010 inches. The relieved portion of the blade faces the screen with the result that the trailing edge of the blade is tapered between 18 and 30 degrees away from the screen surface. The blade taper creates a strong negative pressure pulse which keeps the screen clear. Holes drilled through the relieved portion of the blade allow fluid circulation through the blade into the region of low pressure generated by the relieved portion passing over the screen. The circulation holes create micro turbulence which keeps a slurry of water and paper fibers fluidized.

The advantages of the improved rotor may be employed in a cylindrical screen where foils are moved over the screen surface to create a negative pressure pulse whereby the screen is prevented from clogging. The advantages of the rotor are incorporated by adding holes which pass through the foils to create micro turbulence which aides the cleaning of the screen surface and maintains the stock in a fluidized state.

It is a feature of the present invention to provide a pulp de-trasher which does not shred plastic which is mixed with pulp.

It is a further feature of the present invention to provide a pulp de-trasher which allows pulp to be passed through a screen more rapidly.

It is another feature of the present invention to provide a blade for a pulp de-trasher which reduces shredding of plastic film contained in pulped office waste paper.

Further objects, features and advantages of the invention will be apparent from the following detailed description when taken in conjunction with the accompanying drawings.

DESCRIPTION OF THE PREFERRED EMBODIMENTS

Figure 1:
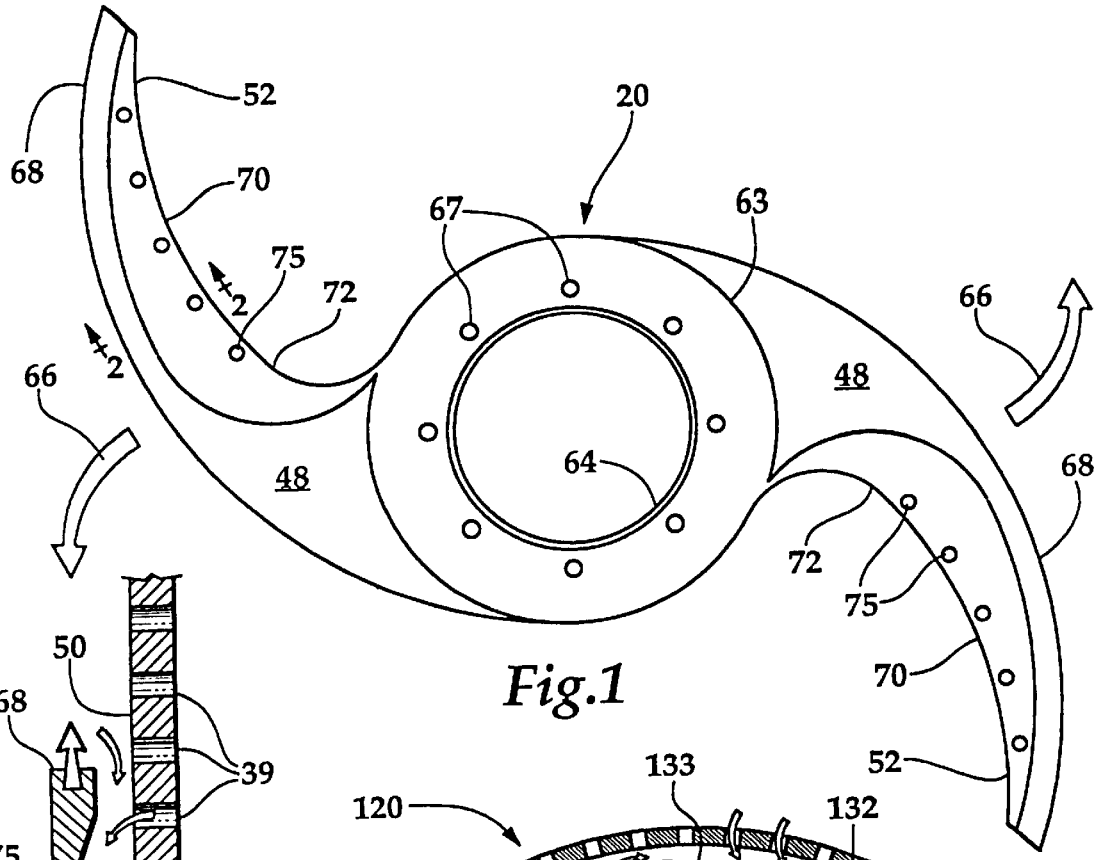
FIG. 1 is a bottom plan view of the rotor of this invention.
Figure 2:
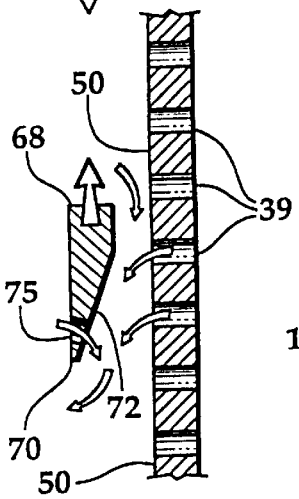
FIG. 2 is a schematic cross-sectional view of the rotor of FIG. 1 taken along section line 2—2 and shown in relation to the screen over which the rotor passes.
Figure 4:
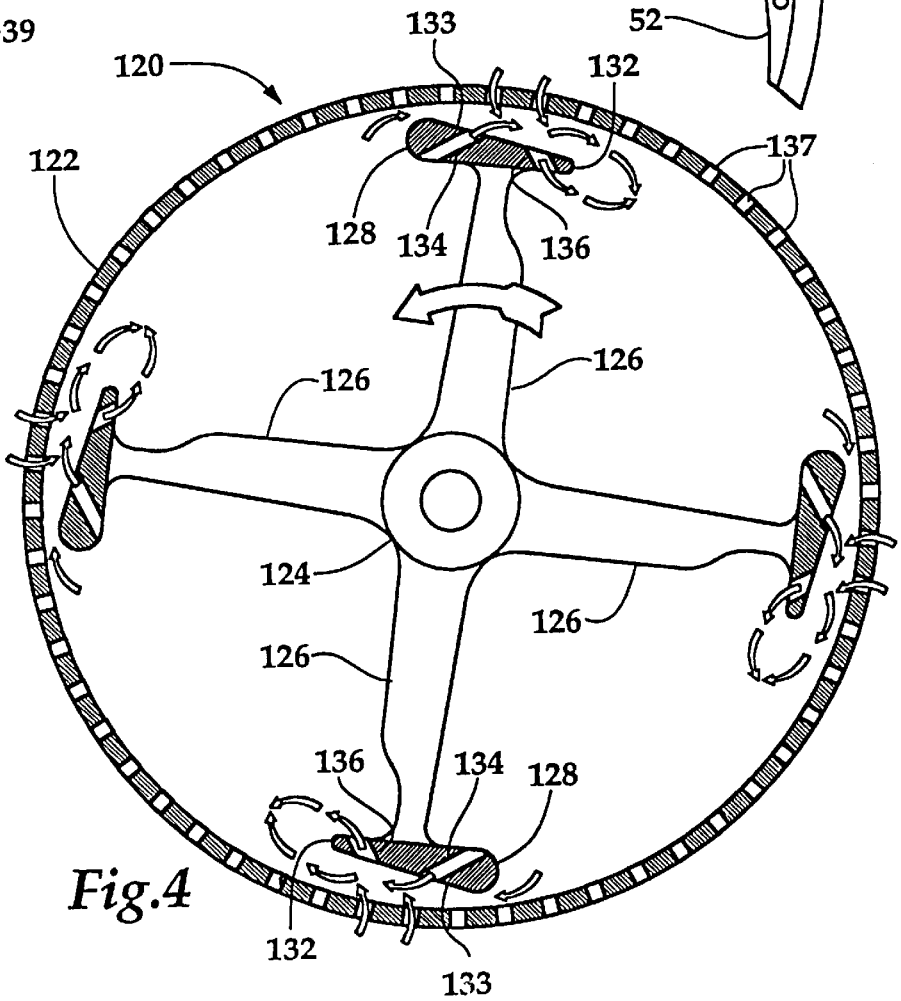
FIG. 4 is a top cross-sectional view of a cylindrical screen with foils employing the advantages of the rotor of FIG. 1.
Figure 3:
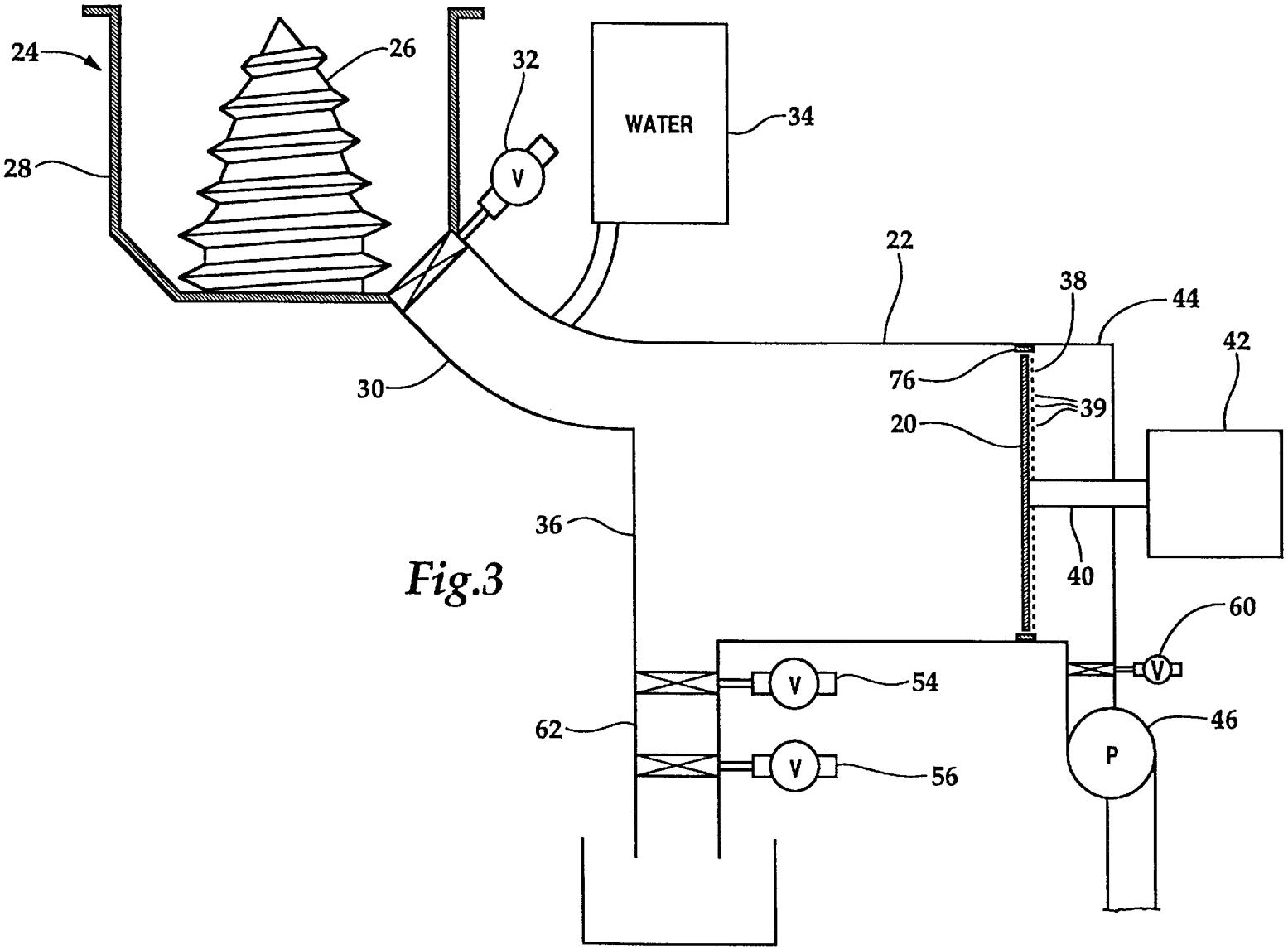
FIG. 3 is a schematic view of a pulper and a de-trasher which employs the rotor of FIG. 1.

Referring more particularly to FIGS. 1–4, wherein like numbers refer to similar parts, a rotor 20 is mounted in a de-trasher 22 as shown in FIG. 2. The de-trasher 22 is supplied with a slurry of paper fiber stock from a pulper 24, as shown in FIG. 3. Waste paper collected from offices which is intended for recycling is typically contaminated with items of trash such as staples, paper clips, plastic bags, view foils, envelope windows, and various plastic films. This flow of mixed paper and trash is supplied to the pulper 24. Water is added in proportion to the dry office waste paper so that the final pulp will consist of twelve to eighteen percent fiber. The pulper 24 is typically operated in a batch mode, but may be operated in a continuous mode. The water, various chemical aids to pulping, and recycled office waste is processed in the pulper 24 until a slurry of water and paper fibers is formed. An agitator 26 mixes the water and paper waste causing the waste paper to be defibered. The contents of the pulper vessel 28 is then dumped from the pulper 24 through a pipe 30. Flow into the pipe 30 is controlled by a gate valve 32. Water 34 is added to the stock as it flows into the de-trasher vessel 36 to dilute the stock to a fiber dry weight content of between three and five percent.

The de-trasher vessel 36 is divided by a screen 38 which has a multiplicity of openings 39. The openings 39 in the screen 38 are typically round and have a uniform diameter which is typically between one-quarter and one-half inch. The rotor 20 is mounted on a shaft 40 which is driven by a motor 42.

A vacuum is drawn on the portion 44 of the vessel 36 formed by the screen 38. Vacuum is supplied by a pump 46. The rotor 20 is positioned with the bottom surface 48 of the rotor 20, as shown in FIG. 1, adjacent the surface 50 of the screen 38. The spacing between the rotor surface 48 and the screen surface 50 is preferably between 0.005 and 0.010 inches. The motor 44 drives the rotor 20 so that it has a tip speed of about 5,000 feet per minute, which for a forty-four inch rotor corresponds to a rotation rate of approximately 450 rpm.

In a typical sequence of operations, the de-trasher 22, the pump 46 and motor 42 are started and the contents of the pulper 24 are diluted by water supply 34 and allowed to flow thru pipe 30 into the de-trasher 22. The pump 46 draws the paper stock through the screen 38. The rotor 20 operates to keep the paper stock fluid and to prevent clogging of the screen 38. As the level of paper stock falls in the de-trasher vessel 36 the rotor splashes the stock excessively and the motor 42 and pump 46 are shut down. The chamber is then filled with water and the pump and motor are again activated. After the majority of stock has been removed from the vessel 36 the remaining water and trash are drained through a first valve 54 and a second valve 56 to a disposal unit 58. During drainage of the remaining water and trash a valve 60 can be used to isolate the vessel 36 from the stock drain pipe 62. If required, depending on the amount of trash in the waste paper, the cycle and be repeated. The valves 54 and 56 can be used to form a chamber for emptying trash while the de-trasher is processing stock.

The arrangement of the pulper 24 and de-trasher 22 is conventional. The improvement consists of using a rotor 20. A conventional rotor has been found to shred plastic bags and other plastic films so they pass through the screen and must be removed at greater expense downstream of the de-trasher. Furthermore, conventional rotors have been found to be prone to the wrapping of plastic, particularly plastic bags, around the blades of the rotor. The wrapped bags build up on the rotor and increasing the mass being rotated, thus increasing resistance to motion through the stock so that power consumption is increased.

The rotor 20 overcome this limitations of existing rotors by employing blades 52 forming the rotor 20 having a unique shape. The rotor 20 is also more closely spaced from the screen 38 then is typical in an existing de-trasher.

The shape of the rotor 20 and blades 52 is shown in FIG. 1 and FIG. 2. The rotor 20 is forty-four inches in diameter and is one inch thick, and has a central portion 63 with a central opening 64 which has a diameter of eight and one-quarter inches. A hub (not shown) mounted to the shaft 40 protrudes through the central opening 64. The central portion 63 is counter-bored on a fourteen inch diameter to a thickness of about 0.56 inches so the entire central portion 63 is relieved below the level of the blades. Bolt holes 67 extend through the central portion 63 and allow bolts to pass into the hub (not shown) which attaches attach the rotor 20 to the shaft 40.

The rotor 20 has two blades 52 which extend from the central portion 63. The blades sweep away from the direction of motion of the rotor 20 as indicated by arrows 66 in FIG. 1. The blades 52 have blunt leading edges 68, and trailing edges 70 which are cut away to form an eighteen degree bevel surface 72. The relieved portions of each blade define five holes 75 positioned upstream of the trailing edge 70. The holes are formed perpendicular to the beveled surfaces 72. The relieved portions adjacent the trailing edges 70 create low pressure pulses as the blades 52 move over the surface 50 of the screen 38. The rapid increase in volume between the screen 38 and the blade 52 cause by the movement of the beveled surfaces 72 of the blades over the portion of the screen previously covered by the flat surface 48 of the blade 52 draws liquid into the space created between the surface 50 of the screen and the beveled surfaces 72. Responding to the decreased pressure opposite the beveled surfaces 72 liquid moves through the screen openings 39 towards the rotor 20 removing any blockage of the openings 39. At the same time liquid flows through the holes 75 into the low pressure volume created by the beveled surface 72 the mixture of liquid flowing through the blades 52 and through the screen 38 in combination with the trailing edges 70 create micro turbulence which fluidizes the stock.

The rotor is typically fabricated of hardenable metal, for example 17-4PH stainless steel or stainless steel type 410 and hardened to 42 to 46 Rockwell C hardness. The rotor may be cut from a steel blank with an abrasive water jet and finished, machined or ground to its final shape.

Close positioning of the rotor 20 to the screen 38, sometimes referred to as a barrier plate, is critical to developing the pressure pulse which cleans the screen 38 and to preventing plastic bags from becoming wrapped around the blades. The spacing between the rotor surface 48 and the screen surface 50 is preferably between 0.005 and 0.010 inches, a gap of greater than 0.125 would probably be totally ineffectual.

Obtaining the fine gap between the rotor 20 and the barrier screen 38 can require careful shimming between the rotor 20 and the hub (not shown). A better solution which allows adjustment of the plane defined by the surface 50 of the screen 38 is to mount the screen 38 so it can be adjusted. If the screen 38 is bolted to a circumferential flange 76, a series of circumferentially positioned set screws (not shown) may be positioned to extend from the screen and engage the flange to hold the screen away from the flange and thus position the screen 38 with respect to the rotor 20. Once the screen is aligned to be parallel with the surfaces 48 of the rotor 20, bolts (not shown) can be used to lock the screen 38 to the flange 76.

Tests Performed with Water

A prior art rotor and the rotor 20 of this invention have been tested on both water and pulp. For the water test, two barrel liners and one trash bag, which is a lighter weight plastic than the barrel liners, were placed in the de-trasher. Water was added to the pulper and the de-trasher was run for 10 minutes in recirculation mode, so that whatever passed through the screen came back into the pulper and was then passed back into the de-trasher. Following 10 minutes, the de-trasher was flushed using the water in the pulper. A gauge was set up to read the number of amps drawn by the motor driving the rotor.

For the run with the improved rotor 20, the clearance was 0.005" to 0.010" between the rotor 20 and the screen 38. After 10 minutes with the improved rotor, the three plastic bags came out in the de-trasher dump. Although the new rotor did tear the bags in some places, the bags were mostly intact and the torn parts were still large. Two of those pieces were trapped behind the rotor. The de-trasher pulled 11.5 amps in no load and 13.75 amps during operation.

The prior art rotor was run at both a tight clearance (0.005" and 0.010") and a normal clearance (0.200"). The tight clearance caused severe ripping of the plastic. The water being recirculated back to the pulper was full of plastic, meaning that the plastic was reduced in size enough to pass through the grate. All that was left were confetti like pieces of plastic. Also, there was more plastic trapped behind the rotor than there was with the new rotor. At this clearance the amps were 12 in no load and 23 in operation.

At the larger clearance with the prior art rotor, there was no shredding, but all three bags were wrapped tightly around the rotor. The no load was 11.6 amps and in operation the de-trasher pulled 20 amps.

TABLE 1

Summary of De-Trasher Rotor Results on Water

| Rotor | Clearance (in.) | Amps No Load | Amps Operating | Comments |
|---|---|---|---|---|
| New | 0.005–0.010 | 11.5 | 13.75 | Some tearing; no shredding |
| Old | 0.005–0.010 | 12 | 23 | Massive shredding |
| Old | 0.200 | 11.6 | 20 | No tearing or shredding; plastic wound on rotor |

Tests Performed with Pulp

Batches of 1,000 air dry pounds of a mixture of 70 percent ONP and 30 percent OMG were pulped at a target consistency of 14 percent for 20 minutes with a Maule rotor. The target temperature was 120° F. As in the water trials, the de-trashing units were seeded with two barrel liners and one trash bag to simulate a worst case scenario. After pulping was complete, the batch was dumped through the de-trasher and into the pulper dump chest. The dump time was measured and recorded and the amps used by the de-trasher was recorded from the gauge current gauge.

The prior art rotor was run first. Its clearance was 0.200 inches. The pulp dumped extremely slowly. The rotational speed of the pulper rotor was varied from 200 rpm to 275 rpm depending on the amount of stock that was being thrown by the rotor and how quickly stock was being dumped into the dump chest. For the most part, the speed was 250 rpm and higher. Also, the pump was stopped and started twice to try to speed up the dump. But, the total dumping time was 83 minutes. At 75 minutes, water was added underneath the prior art impeller to speed up dumping. Following the completion of the dump, the de-trasher was flushed. Very little plastic was in the trash box under the de-trasher. Opening the de-trasher revealed that all three bags had been wound around the rotor very tightly. During operation, the de-trasher pulled 21.5 amps.

The prior art rotor was pulled out and the newly designed rotor 20 was put in. A clearance of 0.005" to 0.010" was requested, but checking the clearance afterward showed that the clearance was between 0.010" and 0.030". Dumping was much quicker with the new rotor. As in the first batch, the pulper rotor speed was kept over 200, in this case between 225 and 250 until the pulper rotor began to throw stock as the level in the pulper decreased, which necessitated slowing the rotor down to prevent the stock from being thrown. After 31.25 minutes, the dump was completed. The de-trasher flush discharged the two barrel liners—mostly intact—into the trash box, along with some larger pieces that had been torn from the barrel liner and trash bag. When the de-trasher was opened, it was noticed that the majority of the trash bag had wrapped around the rotor, but it had not been shredded, only torn. Compared to the old rotor, the new rotor was wrapped much less severely. Running the new rotor at the closer clearance should prevent the plastic from wrapping around the rotor.

The temperature when dumping started was 15° F. higher for the new rotor than it was for the old rotor. The temperature difference contributed to the lower dump time, but is not likely responsible for decreasing the dump time by over 60 minutes.

The new rotor pulled 12.8 amps during operation, which was unexpected because it pulled 13.57 while running with water. Table 2 shows the changes in pulper speed and the points at which the pump was turned off and then on during the dump for both runs. Table 3 is a summary of the dump results for the two batches, including the consistency and the defibering index, as measured on a 0.010" slotted Valley Flat Screen.

TABLE 2

Changes in Operation During the Dump Cycle

| Old Rotor Time (minutes) | Old Rotor Change | New Rotor Time (minutes) | New Rotor Change |
|---|---|---|---|
| 0 | speed at 225 | 0 | speed at 225 |
| 5.5 | speed at 250 | 5.5 | speed at 250 |
| 10 | speed at 275 | 20 | speed at 200 - tossing stock |
| 12 | speed at 250 - vibration at 275 | 23 | speed at 150 - tossing stock |
| 22.5 | speed at 225 - tossing stock | 25 | speed at 75 - tossing stock |
| 24.25 | speed at 200 - tossing stock | 25.75 | speed at 50 - tossing stock |
| 25 | speed at 275 - stopped stock tossing | 30 | pump stopped, then started |
| 32.5 | pump stopped, then started | 31.25 | dumping completed |
| 60 | speed at 250 - throwing stock | | |
| 64 | pump stopped, then started | | |
| 66.5 | speed at 175 throwing stock | | |
| 75 | began adding water under the Maule | | |
| 83 | dumping completed | | |

TABLE 3

Summary of Rotor Results

| Rotor | Clearance (in.) | Amps | Csy. (%) | Defibering Index (%) | Comments |
|---|---|---|---|---|---|
| Old | 0.200 | 21.5 | 6.3 | 99.7 | Plastic wound on rotor |
| New | 0.010–0.030 | 12.8 | 6.0 | 100 | some tearing; no shredding |

A pulp cleaning screen 120 of the type employing a cylindrical screen 122 with a concentric rotor 124 is shown in FIG. 3. The rotor 124 is shown with four arms 126 which are typically employed with a twenty-four inch diameter screen. Typically screens employ pulsation generating devices such as foils which are moved over the screen surface to create negative and positive pressure pulses to keep the screen from clogging. The improved foil 128 for a twenty-four inch diameter screen is about three and one-half inches long in a circumferential direction and about one and one-half into thick at the leading edge 130 tapering to a thickness of one-half inch at the trailing edge 132. The foil 128 will typically be one to several feet tall parallel to the cylindrical axis defined by the screen. A bottom surface 133 of the screen is flat and angled slightly away from the screen 122 so that the gap between the screen 122 and the foil 128 increases from the leading edge 130 to the trailing edge 132. This increasing gap causes fluid to be drawn through holes 137 in the screen 122. Holes 134 adjacent to the leading edge 130 of the foil 128 aid in creating microturbulence. Holes 136 may also be used in connection with the holes 134 to improve the performance of the screen 120.

It should be understood that the rotor 20 may have a diameter of between 24 and 60 inches depending on the size of the de-trasher. As the diameter of the blade varies the optimal angle of the bevel surface 72 will change.

It is understood that the invention is not limited to the particular construction and arrangement of parts herein illustrated and described, but embraces such modified forms thereof as come within the scope of the following claims.

I claim:

1. An apparatus for separating trash from pulp made from recycled paper, the apparatus comprising:

a vessel;

a screen dividing the vessel into a first chamber and a second chamber;

a rotor closely spaced from the screen in the first chamber, the rotor having two blades which extend from a central portion, each blade having a blunt leading edge and a trailing edge;

a shaft connecting the rotor to a drive motor for causing the rotor to rotate;

portions of each blade which define a flat surface extending from near the leading edge, the flat surface being closely spaced from the screen, and portions of each blade defining a tapered surface joining the flat surface and extending away from the screen and towards the trailing edge; and each blade having portions defining a plurality of holes extending through the tapered surface of the blade.

2. The apparatus of claim 1 wherein the tapered surface on a blade extends at an angle of about eighteen degrees from a plane defined by the flat surface on the same blade.

3. The apparatus of claim 1 wherein the flat surface is spaced about 0.005 inches to about 0.010 inches from the screen.

4. The apparatus of claim 1 wherein the screen has portions defining a multiplicity of holes with a diameter of between about one-quarter and about one-half inch.

5. The apparatus of claim 1 wherein the tapered surface on a blade extends at an angle of between about eighteen degrees and about thirty degree from a plane defined by the flat surface on the same blade.

6. A rotor for use in a device for removing trash from pulp made from recycled paper; the rotor comprising:

a central portion having portions defining an opening for mounting of the rotor to a rotating shaft;

a first blade extending from the central portion;

a second blade extending from the central portion substantially opposite the first blade and having the same shape as the first blade, each blade having a blunt leading edge and a trailing edge;

each blade having a flat surface extending from near the leading edge and a tapered surface joining the flat surface and extending from the trailing edge and wherein the tapered surface makes an angle of between about eighteen degrees and about thirty degree with a plane defined by the flat surface; and each blade having portions forming a plurality of holes extending through the blade, the holes positioned along the trailing edge extending through the blade and opening onto the tapered surface.

7. An apparatus for separating trash from pulp made from recycled paper, the apparatus comprising:

a vessel;

a screen dividing the vessel into a first chamber which receives a pulp and trash mixture and where trash is retained, and a second chamber which receives pulp from the first chamber;

a shaft which extends through the shaft and which is driven to rotate within the first chamber;

a rotor fixed to the shaft to rotate in closely spaced relation to the screen in the first chamber;

portions of the rotor defining a first blade and a second blade extending from a central portion, wherein the rotor is rotates in a single direction, and each blade has a leading edge and a trailing edge spaced behind the leading edge in the direction of rotation, the leading edge being blunt;

portions of each blade defining a planar surface adjacent the leading edge which is closely spaced a first distance from the screen;

portions of each blade defining a relieved surface which extends from the blade planar surface and which is spaced a distance greater than the first distance from the screen, the relieved surface extending to the trailing edge; and portions of each blade defining a plurality of holes extending through the relieved surface.

8. The apparatus of claim 7 wherein the first distance is between about 0.005 inches to about 0.010 inches from the screen.

9. The apparatus of claim 7 wherein the screen has portions defining a multiplicity of holes with a diameter of between about one-quarter and about one-half inch.

10. The apparatus of claim 7 wherein the relieved surface on a blade extends at an angle of between about eighteen degrees and about thirty degree from the planar surface.

11. The apparatus of claim 7 wherein the relieved surface on a blade extends at an angle of about eighteen degrees from the planar surface on the same blade.

* * * * *